United States Patent [19]

Key

[11] Patent Number: 4,889,219

[45] Date of Patent: Dec. 26, 1989

[54] METHOD AND APPARATUS FOR THE RECEIVING OF CARBON BLACK PELLETS FOR WEIGHING PRIOR TO INJECTION INTO A MIXER WHICH INHIBITS THE ACCUMULATION OF CARBON BLACK FINES ON INTERNAL SURFACES

[76] Inventor: Ted G. Key, HCR3, Box 865 F1, New Braunfels, Tex. 78132

[21] Appl. No.: 233,842

[22] Filed: Aug. 16, 1988

Related U.S. Application Data

[63] Continuation of Ser. No. 25,966, Mar. 16, 1987, abandoned.

[51] Int. Cl.[4] ..... B65G 11/10

[52] U.S. Cl. ..... 193/25 R; 220/401; 220/403

[58] Field of Search ..... 193/25 R, 25 A, 2 B, 193/7, 25 E, 25 S; 52/192, 197, 222; 220/401, 403, 404; 141/391; 222/105, 185, 460

[56] References Cited

U.S. PATENT DOCUMENTS

| | | | |
|---|---|---|---|
| 409,669 | 8/1889 | Cooley | 193/25 R |
| 2,658,603 | 11/1953 | Fernald | 193/25 R |
| 3,105,617 | 10/1963 | Felldin | 222/185 |
| 3,280,952 | 10/1966 | Ruggiero | 193/7 |
| 3,602,400 | 8/1971 | Cooke | 222/460 X |
| 3,858,772 | 1/1975 | Myers, Jr. | 222/460 |

*Primary Examiner*—Robert J. Spar
*Assistant Examiner*—D. Glenn Dayoan
*Attorney, Agent, or Firm*—Cox & Smith Incorporated

[57] ABSTRACT

A method and apparatus for receiving of carbon black pellets for weighing prior to injection into an internal mixer which inhibits the accumulation of carbon black fines on the internal surfaces including a receiving and weighing hopper having walls formed of smooth flexible material which flexes upon loading and unloading from an equilibrium position to expel carbon black fines that tend to adhere on the wall surfaces of the hopper.

8 Claims, 5 Drawing Sheets

METHOD AND APPARATUS FOR THE RECEIVING OF CARBON BLACK PELLETS FOR WEIGHING PRIOR TO INJECTION INTO A MIXER WHICH INHIBITS THE ACCUMULATION OF CARBON BLACK FINES ON INTERNAL SURFACES

This application is a continuation of my co-pending application Ser. No. 025,966, filed on Mar. 16, 1987, now abandoned.

BACKGROUND OF THE INVENTION

The problem with degradation and breakage of the carbon black pellets and the build-up of carbon black dust and fines on surfaces of carbon black handling apparatus has existed since the beginning of automated feeding and weighing of carbon black for the injection into a mixer. This problem has become even more critical in recent years due to the more sophisticated and unique rubber compounds. These newer compounds require softer, more fragile carbon black pellets which, due to their softer nature, will disperse more thoroughly into the rubber batch. As the sophistication of rubber compounding technology has increased, complete dispersion of the carbon black is more critical than ever before. The softer the pellets, the more complete the dispersion within a given time frame during the mixing process.

In rubber mixing, various ingredients are injected into a mixer to be compounded into the rubber. By its nature, carbon black will not mix well in its original form. As produced, carbon black is a very fine (micron size) powder. If injected into the mixer in that form, it will simply float on top of the rubber and will not mix well into the rubber batch. In order to overcome this problem, the carbon black, at the point of manufacture, is made into pellets. In the pellet form, the carbon black will then mix well into the rubber. First, the pellets themselves will mix, then the pellets will break down into powder and the powder will complete the total dispersion of the carbon black in the rubber batch. The making of the pellets is in of itself a science. These small pellets are made according to very close specifications. By their hardness, mass strength, elasticity, as well as other technical considerations, mixing performance can be determined.

These pellets are extremely fragile and easily broken. When broken, the pellets become powder (normally called "fines"). As in their original form, these powders will not disperse into the batch, but rather will "float" on top of the rubber. These pockets of powders become major flaws in the final product which most often causes the total product to be scrapped. Secondly, when high concentrations of fines are allowed to enter the mixer the time involved to mix the batch can become indeterminate, thereby extending the manufacturing time to unacceptable levels. Further, the mixing requires very specific time and temperature control, otherwise the rubber will "cure" inside the mixer due to the higher the temperatures reached during an extended mixing time. It therefore becomes highly significant to the success of the mixing operation that the pellets be handled in the most gentle manner possible, that any dust (fines) not be allowed to accumulate within the handling and feeding equipment where it may break away and be fed into the mixer.

When the pellets are broken, the resultant powders (fines) are highly prone to adhering to any surface with which they come into contact. This occurs primarily at any point within the system where material must be held for further process. The carbon black is metered closely by weight in conformance with a precise recipe, dependent upon the type of rubber compound being mixed. In the typical operation, a batch weight ranging from a few pounds to 500 or more may be required, with a tolerance of plus or minus 1% of total batch weight. The bulk densities of the carbon black pellets may vary from 20 to 45 pounds per cubic foot. These weights, once conveyed into the weigh hopper, with variables both in bulk density and total amount must be fed within a very specific cycle time, usually less than 90 seconds. Should this time cycle become unpredictable, all downstream operations are jeopardized. The mixing process is a closely timed, continuous operation, each step dependent upon the timely completion of all preceding steps in the operation.

The "fines", if allowed to accumulate within the weigh hopper creates significant problems. First, the build-up within the hopper will break away from surfaces, be fed to the mixer where it will not mix thoroughly, creating very high reject levels in the final product. Secondly, the build-up chokes off the hopper, thereby reducing the ability of the hopper to deliver accurate amounts within the required time. Further, extreme levels of build-up on hopper surfaces may create excessive maintenance shut-down time for cleaning and servicing the hopper.

As far as is known, there have been many attempts to use various types of hopper configurations. Some types of known attempts are: Extreme slope angles on hopper sides, ordinarily 70 degrees or more; hoppers which attempt to fluidize the material and thereby not require any direct contact with any hard surfaces. Further attempts to prohibit build-up and pellet breakage have included vibrators, inclines, stainless steel and polished surfaces, synthetic coatings and laminations. In addition to these mechanical attempts, there have been several methods of applying differing electrical charges to various parts of the equipment in order to control the ionic attraction of the material. These attempts have added to the problem rather than contributing to the solution.

This invention solves the problem of the carbon black pellets sticking to the handling equipment during the rubber manufacturing process by the use of a smooth flexible hopper surface which by a physical motion or flexing of the surface during the dump cycle of the hopper acts to expel any of the micron size particles which tend to adhere to the hopper sides. The movement of the surface is believed to accomplish the task due to several events. It provides an immediate release of the limiting friction. Secondly, the invention significantly reduces the kinetic friction between the smooth hopper surfaces and the carbon black particles being released from the hopper. The reduced kinetic friction reduces greatly the abrading of the pellets, and it minimizes the opportunity for ionic attraction and minimizes charge transfer during movement of the carbon black out of the hopper. Also, carbon black dust is hygroscopic. The hopper surface, as it flexes, minimizes the opportunity for the particles to adhere due to surface moisture within the dust particles.

The entire hopper assembly is constructed in such a way as to take geodesic advantage of the hopper wall construction. It will provide an internal surface which when loaded, will increase in tension and upon dumping, will return to its original shape in a quick "snapping" action. This action creates a surface least likely to provide the initial opportunity for the adhesion of dust to the hopper due to higher kinetic friction, moisture induced adhesion and ionic attraction of the static particles laying on the hopper. Prior methods of trying to solve the problem do not understand nor contemplate the use of a natural acting flexible surface nor do they use the other features of this invention. There may have been hoppers fabricated with inner fabric liners in the past. However, with these devices, as far as is known, releasing action is externally motivated by air injection or vibratory equipment. These devices do not intend the use of the initial flexure of the liner which results in stored kinetic energy to provide an imparted impetus to the carbon black to release from the surface, but rather intend only to vibrate the remaining dust particles from the hopper after it has emptied. The objects of the present invention are to release cleanly, and quickly any carbon black adhering to the hopper surfaces and to provide a physical assistance to the material to move from the hopper at the desired time, and within a very close cycle demand.

Another object of this invention is to minimize the opportunity for formation of lumps and chunks of dust to accumulate in the hopper. The design of the unit provides a type and grade of fabric which has a surface which provides an extremely smooth, non-porous surface. This surface, together with the actions of the hopper panels upon releasing insures that carbon black is not allowed to accumulate within the hopper.

By inhibiting the build-up on the hopper surfaces, the hopper is able to maintain its design feed rate so that a consistent and predictable mixing cycle time is provided. Another object is to improve the quality of the mixes reduce or and eliminate fines concentrations entering the mixer which in other hoppers comes from build-up breaking away from internal hopper surfaces. Another object is to minimize maintenance demands in service shut-downs due to inability to expel completely carbon black which has caked on the internal surfaces of the hopper.

Other objects of the invention will be apparent from the following detailed disclosure.

SUMMARY OF THE INVENTION

The invention relates to a method and apparatus for receiving carbon black pellets for weighing and injecting into a mixer during a rubber making process. The invention includes a hopper which takes advantage of the actions of applied tension, stored kinetic energy of the hopper walls, and smooth flexible walls having surfaces not conducive to adhesion of carbon black dust. In addition to the structure of the hopper walls as described, the invention provides a method of suspending the hopper within a frustoconical support framework which assures that the hopper walls will remain in equilibrium when empty, and when filled, this equilibrium becomes unbalanced. The attempt of the hopper to return to equilibrium assists in the ejection of the material in the hopper and shakes all remaining dust from the hopper walls.

DETAILED DESCRIPTION OF THE INVENTION

Figure 1:
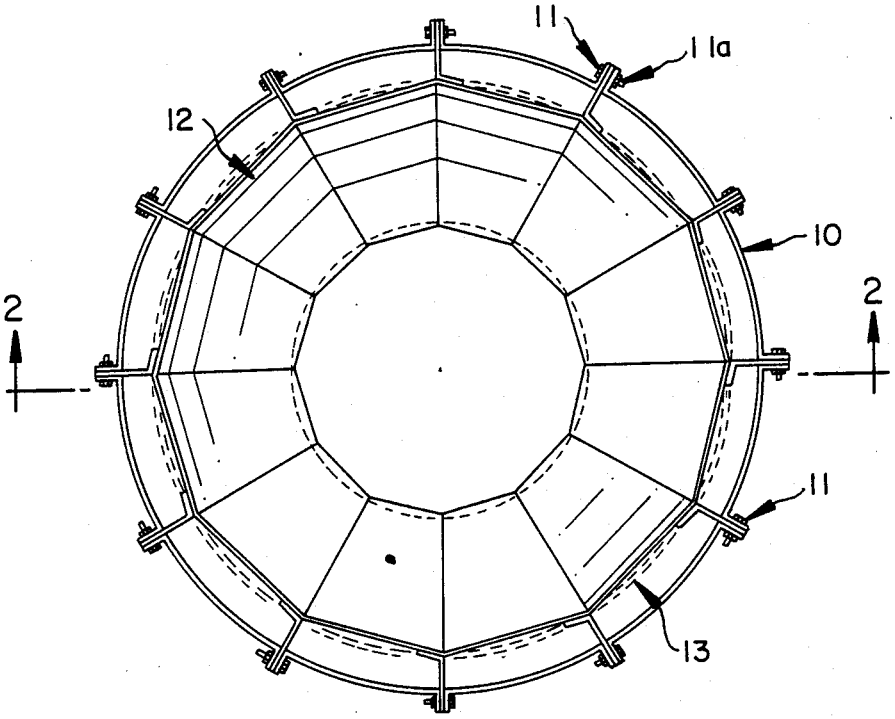
FIG. 1 is a top view of the open hopper
Figure 2:
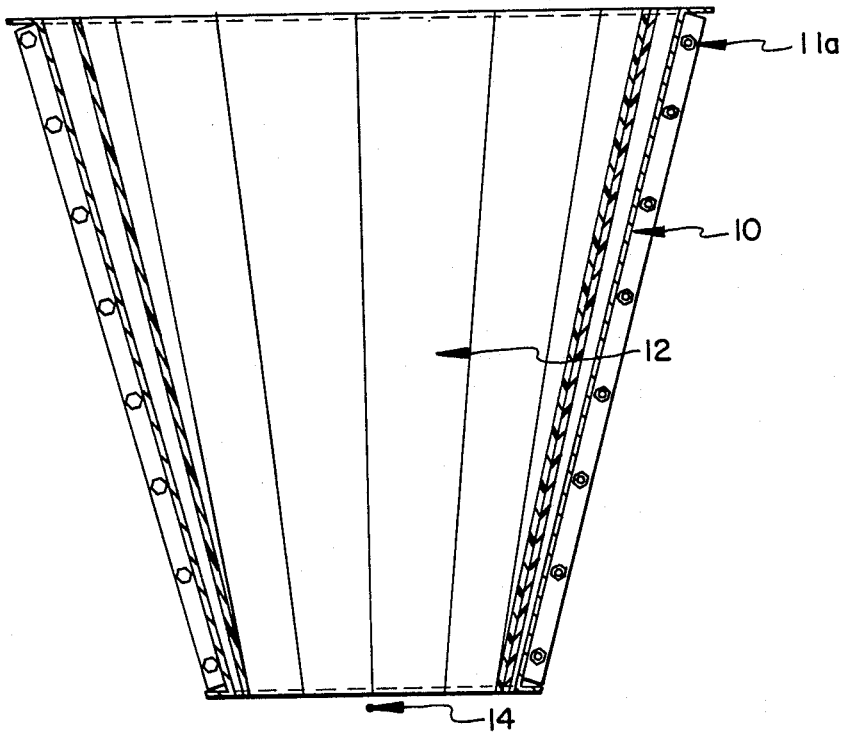
FIG. 2 is a side view of the hopper. The support structure is removed for clarity.

This invention consists of a frustoconical framework (FIG. 1A) which supports a flexible liner (FIG. 2A) fabricated from a non-porous fabric such as "Hypalon" (Dupont's brand name for a polythylene coated nylon). The method of suspending the liner within the framework is such that it will hold the liner in a position of equilibrium over its entire surface.

Figure 1A:
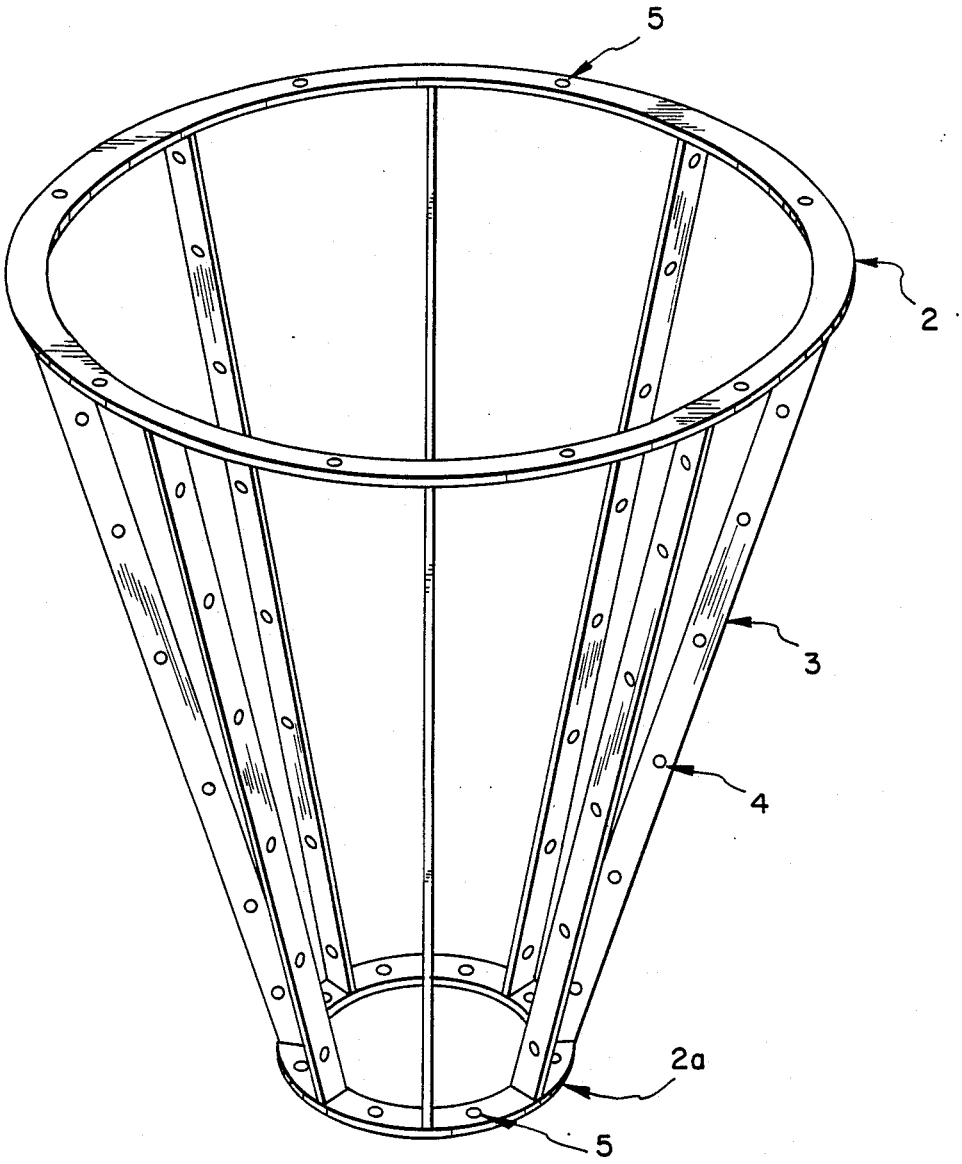
FIG. 1A is an isometric view of the frustoconical framework for clarity.
Figure 2A:
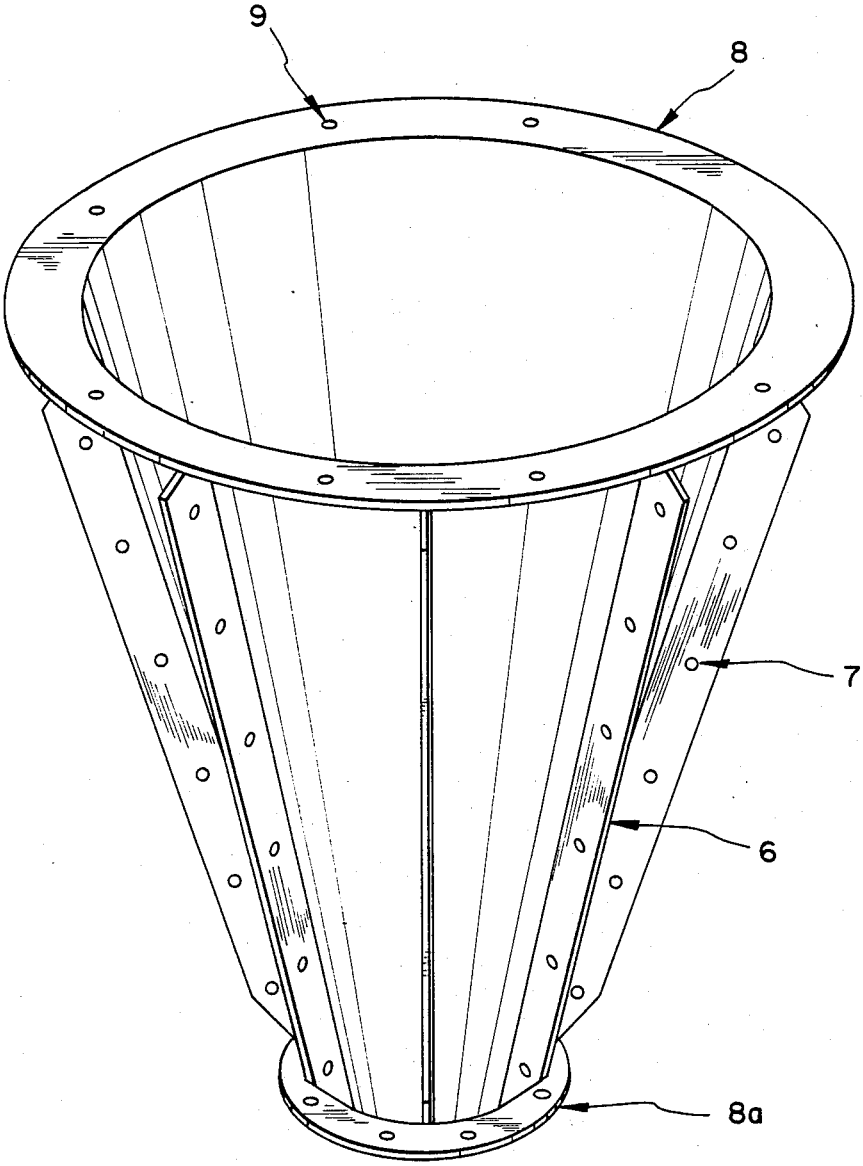
FIG. 2A is an isometric view of the flexible liner shown for clarity.

The framework consists of upper and lower flat steel rings 2 and **2*a* shown in FIG. 1A at the top and bottom of the framework, with heavy section flat bar vertical ribs 3 at appropriate increments around the circumference. The flat bar ribs are mounted flush with the inside diameter of the top and bottom rings 2 and 2*a* with the width of the flat bar ribs along radii of the rings. Along the vertical length of the ribs are holes 4 which are drilled and tapped, so they can be used for mounting the flexible liner in place. About the circumference of the top and bottom rings 2 and 2*a* are drilled holes 5 so as to form a bolting circle which will allow the mounting of a lid on the top and a discharge valve 14** at the bottom.

The flexible liner (FIG. 2A) is fabricated into a frusto or conical funnel shape. Preferably, there should be no horizontal seams. All seams should be glued and heat sealed. Mounted to the external surface of the liner outer peripheral surface at increments matching the ribs of the frame are two strips of fabric formed to make an "L" shape 15 (FIG. 3), then glued and heat welded to the liner 11 back-to-back in order to form a double thickness mounting rib. These ribs 6, (FIG. 2A) which are spaced an equal distance around the circumference, are then punched and a metal eyelet 7 installed so as to match the holes 4 (FIG. 1A) in the vertical ribs of the framework.

The top and bottom of the flexible liner is folded over in order to create flanges 8 and **8*a* (FIG. 2A) which matches the size and shape of the top and bottom rings of the framework. The hole pattern of the flanges is formed the same as the framework top and bottom rings but no metal eyelet is installed in that the flanges of the liner also serve as a sealing gasket between the lid at the top and the dump 14** valve (FIG. 2) at the bottom of the hopper.

When mounting the liner into the framework, the formed ribs 6 of the liner are aligned with each of the flat bar ribs 3 of the framework. A bolt 11 is then inserted through the eyelet of the liner rib, and screwed into the drilled and tapped hole of the framework rib. The nut **11*a*** is tightened only to the extent to insure that it will not back out. The bolt serves only to hold the liner in place as a pin. The liner rib is allowed to "float" within the mounting, being held loosely in place by the bolt through the eyelet.

The top formed flange 8 of the liner is placed between the top ring 2 of the framework and the lid and tightened securely so as to serve as a dust tight gasket. The bottom formed flange 8a is placed between the bottom ring 2a of the framework and the dump valve 14 in order to form a dust tight gasket seal, then tightened to seal the hopper completely dust tight, top and bottom.

Figure 3:
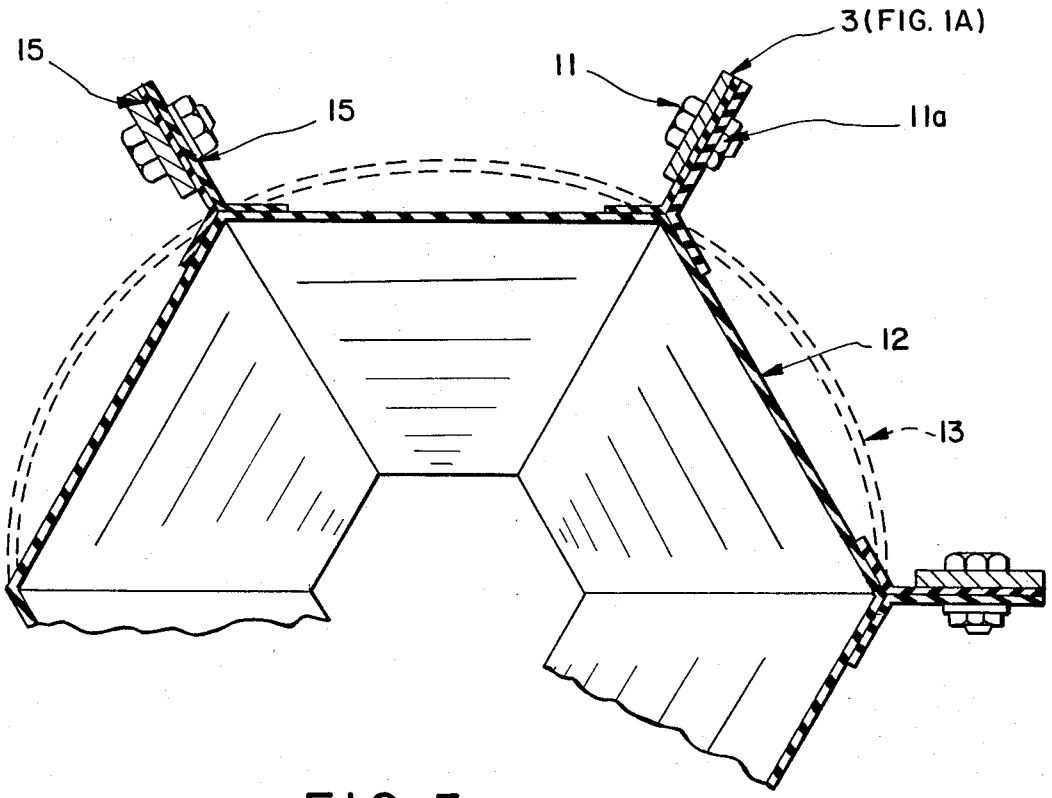
FIG. 3 is simplified top view of the hopper showing the attachment of the suspension system and the panels in more detail.

When filled, the shape of the liner is distorted due to gravity as the material being loaded into the hopper distorts the panels to a circular shape 13 as shown by the broken lines in FIG. 3.

Particular attention should be paid to the fabrication quality, workmanship, finish work and assembly of the hopper prior to installation for service. The fabrication and the assembly of the panels 12 preferably provides for a smooth surface, with equal tension applied in all planes when mounted into the support frame 10. The hopper 12 should be fabricated with minimal seamage, with no horizontal seams upon which material within the hopper may become lodged.

Figure 4:
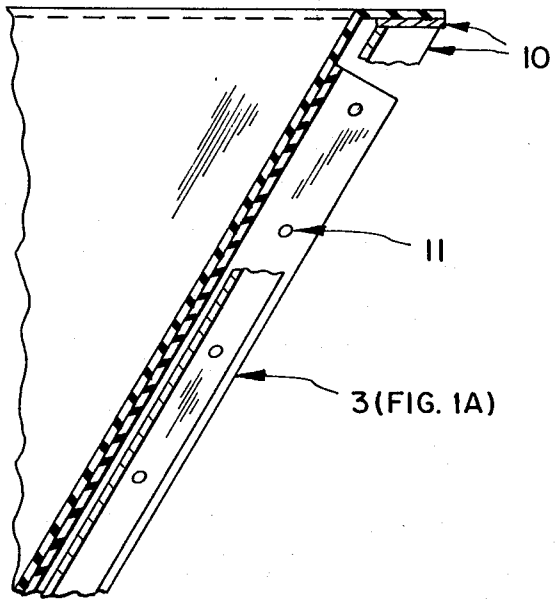
FIG. 4 is a simplified side view of the attachment of a hopper panel and the tension point mountings.

Once installed, the hopper forms a taut surface which assumes equal tension over its entire surface 12 as shown in FIG. 3. The framework 10 holds the hopper 12 equally about the perimeter and along the vertical planes through the bolts 11, and holes 11A as shown in (FIG. 4) so that the hopper 12 remains flexible with no contact with the rigid frame 10. The bolts 11 are arranged so as to keep the hopper 12 centered within the circular frame so that as material is placed with the hopper, there is adequate clearance for the panels 12 to distort without contacting the frame.

Figure 5:
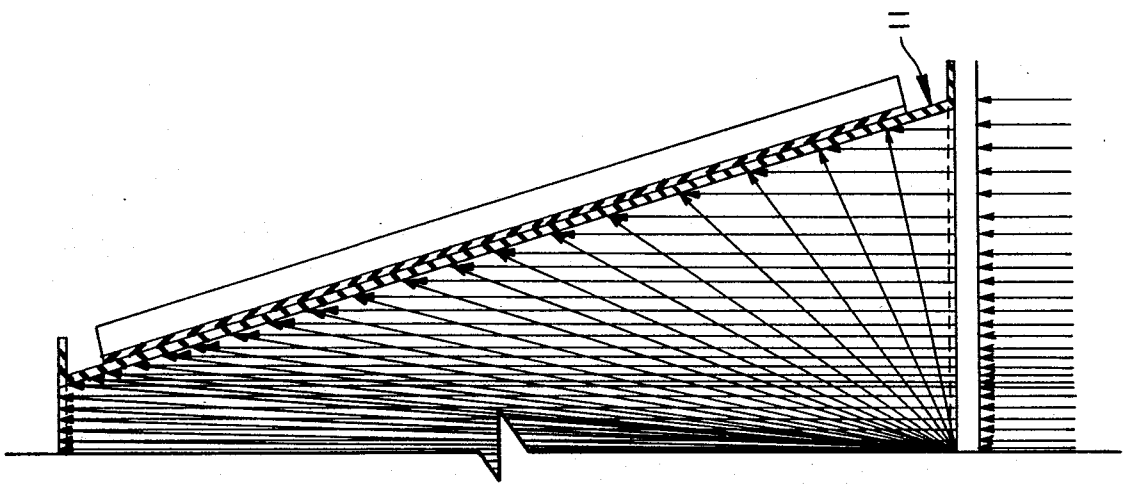
FIG. 5 is a display of the force vector graphics of the anticipated loading within the hopper walls.

Referring to FIG. 5, the pressure, as schematically represented by force vectors, applied to the hopper panels 12 is greatest in the lower part of the hopper and lessens gradually along the vertical sides of the hopper. As the hopper is filled, the equilibrium of the hopper surface is disturbed. As the hopper dump gate 14 is opened, the hopper begins to return to its original shape. Due to the loadings of the hopper surfaces (less at the top and getting greater toward the bottom), the flexing action is continually stronger and quicker going from the top to the bottom of the vertical surface of the hopper so that as the last of the material leaves the hopper, the lower surface shakes all remaining dust and fines from the surface.

Other alternative forms of the hopper would be of a similar configuration. The general application of the tension surface and suspension systems would so designed as to impart the same discharge impetus and surface cleaning action as applied here.

As far as is known, there has not existed a hopper of this type. All previous weigh hoppers, as far as is known have been of a rigid steel construction. Variations of the rigid hopper have included applications of many mechanical assists to enable the hopper to empty and clean. Some of these assists have been: coatings, grinding and polishing of the surfaces, vibrators to shake the hopper and loosen the residue, and aerators to fluidize the material during discharge so that it will flow smoothly. This invention utilizes totally natural forces to allow the material to be discharged cleanly from the hopper and to not allow any build-up of material on the hopper sides.

The advantages of the invention are that the batch quality and consistency are improved due to an improved quality of carbon black delivered to the mixer through the hopper. This is in part due to the lessened generation of fines and the absence of lumps and chunks of fines since the hopper thoroughly cleans itself on each dump cycle and the fines are not allowed to accumulate within the hopper to be injected into the mixer in concentrations. The apparatus generally requires less maintenance, thereby reducing costs, production delays and down time on the mixer and downstream manufacturing processes. With fewer shut-downs for service, the unit is cleaner, creates less atmospheric pollution within the plant due to the greatly reduced opportunity for spillage with the process area. With the benefit of a constant and minimal dump cycle time, overall per unit costs of the final product are lessened and stabilized. The constant feed rate assures more predictability, thereby a more efficient production and planning control. The better and more consistent batch quality provides a lower per unit cost due to a greatly reduced scrap level in the final product.

Applicant's patent application entited "Method And Apparatus For Conveying Carbon Black Which Inhibits The Build-Up Of Carbon Black Fines On Conveying Surfaces" filed on March 16, 1987, is incorporated herein in total by specific reference thereto.

Although the invention has been described in conjunction with the foregoing specific embodiment, many alternatives, variations and modifications will be apparent to those of ordinarily skill in the art and those alternatives, variations and modifications are intended to fall within the spirit and scope of the appended claims.

I claim:

1. A method for receiving and discharging carbon black pellets prior to injection into an internal mixer comprising the steps of:

supplying carbon black pellets to a hopper means having a flexible liner and being of generally conical shape;

maintaining the entire surface of the flexible liner in a state of tension when no pellets are present in the hopper by means of a structural framework constructed of steel or similar material which is attached to the liner equally about the perimeter and along vertical planes wherein said entire surface of said flexible liner is tensioned in all directions;

flexing the flexible liner as pellets are received to store kinetic energy in said flexible liner;

releasing the kinetic energy stored in said flexible liner as pellets are discharged in a manner which returns said flexible liner to its equilibrium position and which thereby accelerates any carbon black fines on the liner surfaces radially inward in order to inhibit the accumulation of carbon black fines on the liner surfaces.

2. The method of claim 1 wherein the flexing of said flexible liner is provided by the weight of the carbon black pellets.

3. A hopper apparatus for receiving and discharging carbon black pellets, comprising:

a flexible liner of generally conical shape having top and bottom openings;

a rigid framework comprising upper and lower rings connected by a plurality of vertically extending framework ribs; and means for mounting said liner within said framework by attaching said liner to said vertically extending framework ribs at a plurality of points all along the length of said framework ribs to maintain it in a state of tension in all directions between the ribs about the perimeter and along vertical planes.

4. The hopper apparatus as set forth in claim 3 wherein said liner further comprises a plurality of vertically extending liner ribs corresponding to said framework ribs for attaching said liner to said framework ribs.

5. The apparatus as set forth in claim 4 wherein the liner ribs are connected to the framework ribs by means of bolts inserted through eyelets in the liner ribs and corresponding holes in the framework ribs.

6. The apparatus as set forth in claim 5 wherein the liner further comprises upper and lower flanges which match the size and shape of the upper and lower rings of said framework.

7. The apparatus as set forth in claim 3 wherein the liner is made of smooth plastic material.

8. The apparatus as set forth in claim 3 wherein the liner is made of polyurethane coated nylon.

* * * * *